United States Patent [19]

Carlson

[11] 3,952,346

[45] Apr. 27, 1976

[54] COLLAPSIBLE ELEVATING BOARD FOR BED MATTRESSES

[76] Inventor: Maurice F. Carlson, 6345 Oakman Blvd., Dearborn, Mich. 48126

[22] Filed: Mar. 14, 1975

[21] Appl. No.: 558,482

[52] U.S. Cl. ..... 5/327 B; 5/71

[51] Int. Cl.[2] ..... A47C 21/00

[58] Field of Search ..... 5/68, 70, 71, 72, 317, 5/327, 327 B

[56] References Cited

UNITED STATES PATENTS

| | | | |
|---|---|---|---|
| 46,569 | 2/1865 | Mathews | 5/68 X |
| 793,428 | 6/1905 | Edgley | 5/68 X |
| 801,667 | 10/1905 | Kintz | 5/68 |
| 3,125,768 | 3/1964 | Rickert | 5/317 R |
| 3,353,196 | 11/1967 | Guillon | 5/327 R |
| 3,683,430 | 8/1972 | Bradley | 5/317 |

*Primary Examiner*—Robert L. Wolfe
*Assistant Examiner*—Andrew M. Calvert
*Attorney, Agent, or Firm*—Adolph G. Martin

[57] ABSTRACT

A collapsible elevating board for insertion between the spring and mattress of a bed for raising one end of the mattress. The elevating board has a flat base and a tiltable member pivotally connected on the forward end to the base. A transverse foot, having both an extended and a retracted position, is pivotally attached to the lower side of the tiltable member. A pivoted riser on the flat base, disposed below the transverse foot, is provided with both an upright and a collapsed position. The riser is adapted in both its upright and collapsed positions, to holdably engage the transverse foot when it is fully extended so as to provide selective alternate elevations for the tiltable member and the bed mattress thereon supported.

1 Claim, 7 Drawing Figures

FIG. 1
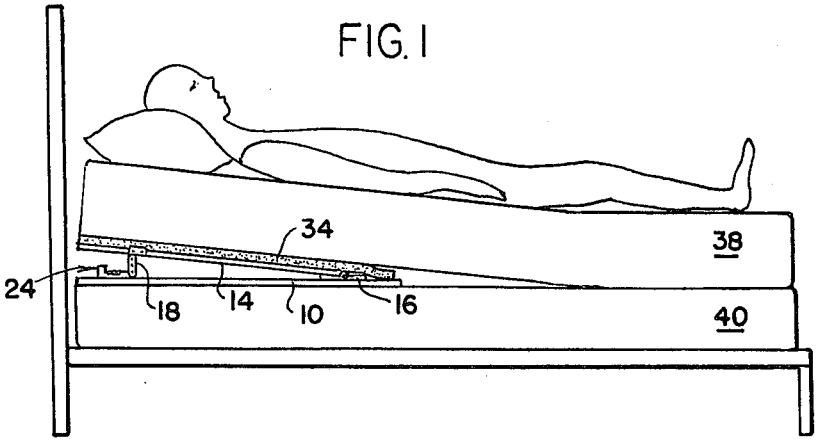
FIG. 2
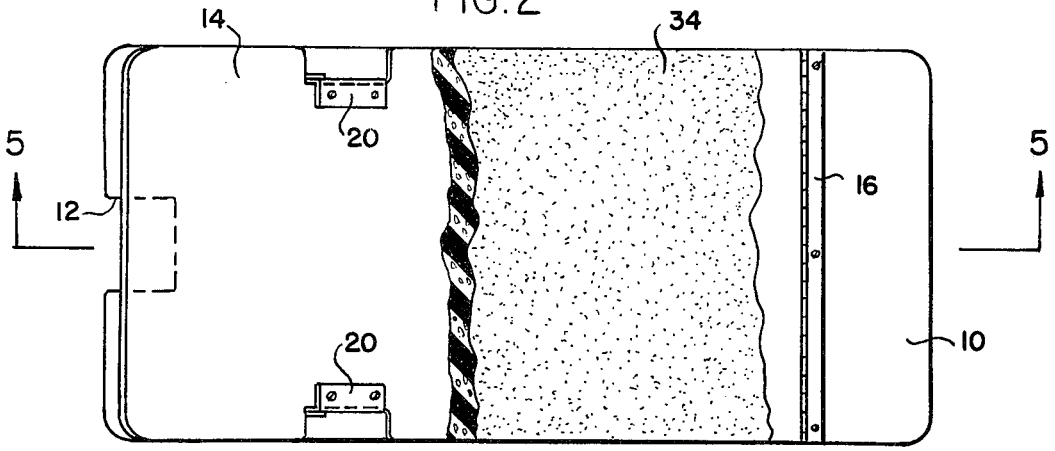
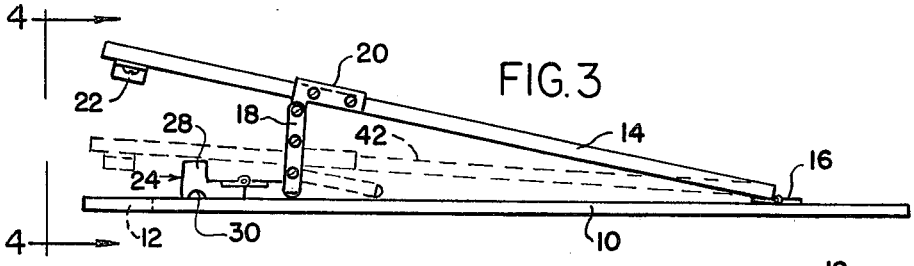
FIG. 3
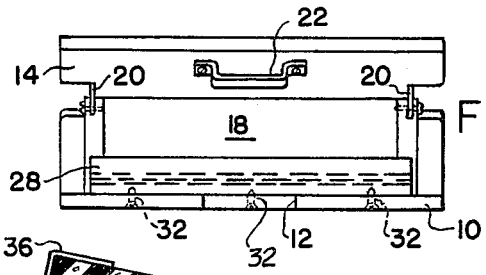
FIG. 4
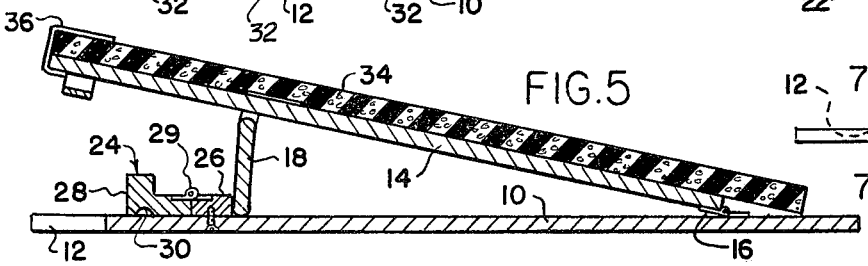
FIG. 5
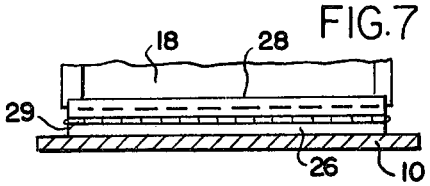
FIG. 7
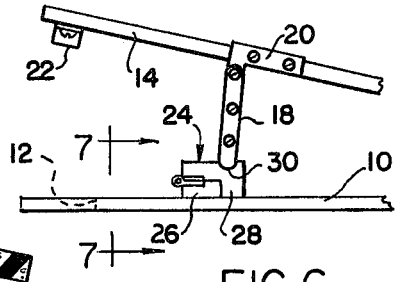
FIG. 6

COLLAPSIBLE ELEVATING BOARD FOR BED MATTRESSES

BACKGROUND OF THE INVENTION

This invention relates generally to devices for use in supporting bed matresses in an elevated position, but more particularly to a collapsible elevating board for use on either double or twin size beds. Such devices traditionally are bulky and unwieldy, and consequently difficult to use and costly to produce. Fully cognizant of these shortcomings, the applicant has developed a light weight readily collapsible bed board which is easy to use and relatively inexpensive to produce.

SUMMARY OF THE INVENTION

This invention consists of a flat base 10 having along the rear edge thereof a hand opening 12. A tiltable member 14 on the flat base 10 is pivotally attached thereto at the forward end by an elongated hinge 16. A transverse foot 18, on the lower side of the tiltable member 14, is pivotally connected thereto at each end by hinges 20. A gripping handle 22 is provided on the tiltable member 14 directly above the hand opening 12 in the flat base 10. A riser 24, consisting of two pivotally connected elongated members 26 and 28, is mounted on the flat base 10 for holdably engaging the transverse foot 18.

DESCRIPTION OF THE DRAWING

FIG. 1 is a side elevation view, showing the applicant's collapsible elevating board inserted between a bed mattress 38 and spring 40 to illustrate the manner in which it is used.

FIG. 2 is a top plan view of the collapsible elevating board, with a portion of the resilient pad 34 broken away, so as to show structural details of the tiltable member 14.

FIG. 3 is a side elevation view of the collapsible elevating board, with the resilient pad 34 removed, showing the tiltable member 14 in its intermediate position.

FIG. 4 is an elevation view, taken substantially on plane 4—4 in FIG. 3, showing the handle 22 on the lower side of the tiltable member 14.

FIG. 5 is a section view, taken substantially on plane 5—5 in FIG. 2, showing structural details of the tiltable member 14 and the flat base 10.

FIG. 6 is a fragmentary view, similar to FIG. 3, showing the riser 24 in its elevated position.

FIG. 7 is a section view, taken substantially on plane 7—7 in FIG. 6, showing structural details of the riser 24.

CONSTRUCTION

For a more detailed description of the invention, reference is made to the drawing in which numeral 10 designates a flat base having along the rear edge thereof a hand opening 12. A tiltable member 14 on the flat base 10 is pivotally attached thereto at the forward end by an elongated hinge 16. A transverse foot 18, on the lower side of the tiltable member 14, is pivotally connected thereto at each end by hinges 20. A gripping handle 22 is provided on the lower side of the tiltable member 14 directly above the hand opening 12 in the flat base 10.

A riser 24, consisting of two elongated members 26 and 28 pivotally connected by a hinge 29, is mounted on the flat base 10 directly below the transverse foot 18. The elongated member 28 has an angular cross section, and a longitudinal groove 30 co-extensive therewith for holdably receiving the transverse foot 18, as shown in FIG. 6. The other elongated member 26 of the riser 24 is attached to the flat base 10 by countersunk screws 32. A resilient pad 34, on the upper side of the tiltable member 14, is secured thereto by suitable means such as the strip of adhesive tape 36 shown in FIG. 5.

The preceding discussion completes a description of the structure characterizing the single embodiment of the applicant's invention herein disclosed; however, to facilitate a more thorough and comprehensive understanding of the subject matter, a discussion of the manner in which the device is used to fulfill its intended function is immediately hereinafter set forth.

USE AND OPERATION

In use, the applicant's collapsible elevating board is inserted between the mattress 38 and spring 40 of either a twin or full size bed, as shown in FIG. 1. If it is desired to elevate the tiltable member 14 to its intermediate position, shown in FIG. 3, the handle 22 is grasped and the tiltable member 14 raised until the transverse foot 18 swings down and holdably engages the forward edge of the elongated member 26 of the riser 24.

If it is desired to elevate the tiltable member 14 to its top position, shown in FIG. 6, the handle 22 is grasped and the tiltable member 14 raised sufficiently to permit the elongated member 27 of the riser 24 to be rotated forwardly about the hinge 29 to its elevated position, shown by the full lines in FIG. 6. The transverse foot 18 is then holdably engaged in the longitudinal groove 30 in the elongated member 28.

When it is desired to collapse the elevating board, the handle 22 is again grasped, and the tiltable member 14 raised sufficiently to permit the elongated member 28 of the riser 24 to be rotated about the hinge 29 to the collapsed position shown by the full lines in FIG. 3. The transverse foot 18 is then pivoted in a counter clockwise direction so that the tiltable member 14 can be dropped to its fully collapsed position, shown by the broken lines 42 in FIG. 3.

Based upon the foregoing discussion, the applicant is of the opinion that his invention has fulfilled a long-felt need in the field of support devices for elevating bed mattresses, and that he has accordingly made a valuable contribution to the related art. The invention, however, was described with reference to the structural details of only a single embodiment, but it will be appreciated by those familiar with the art that the principles involved are susceptible of numerous other practical adaptations.

I therefore claim as new, and desire to secure by Letters Patent:

1. A collapsible elevating board for bed mattresses comprising a flat base, a tiltable member pivotally connected on the forward end to the flat base, a transverse foot pivotally attached to the lower side of the tiltable member having both an extended and a retracted position, a pivoted riser on the flat base disposed below the transverse foot having both an upright and a collapsed position, such riser being adapted in both its upright and collapsed positions to holdably engage the transverse foot when the latter is in its extended position so as to provide selective alternate elevations for the tiltable member.

* * * * *